US009697779B2

(12) United States Patent
Lu et al.

(10) Patent No.: US 9,697,779 B2
(45) Date of Patent: Jul. 4, 2017

(54) DRIVING METHOD AND APPARATUS OF LIQUID CRYSTAL DISPLAY APPARATUS, AND LIQUID CRYSTAL DISPLAY APPARATUS

(71) Applicants: BOE TECHNOLOGY GROUP CO., LTD., Beijing (CN); HEFEI BOE OPTOELECTRONICS TECHNOLOGY CO., LTD., Hefei, Anhui (CN)

(72) Inventors: Haifeng Lu, Beijing (CN); Hengbin Li, Beijing (CN)

(73) Assignees: BOE TECHNOLOGY GROUP CO., LTD., Beijing (CN); HEFEI BOE OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 683 days.

(21) Appl. No.: 14/017,483

(22) Filed: Sep. 4, 2013

(65) Prior Publication Data

US 2014/0071184 A1 Mar. 13, 2014

(30) Foreign Application Priority Data

Sep. 13, 2012 (CN) ..... 2012 1 0339495

(51) Int. Cl.
*G09G 3/36* (2006.01)

(52) U.S. Cl.
CPC ..... *G09G 3/3607* (2013.01); *G09G 3/3614* (2013.01); *G09G 3/3648* (2013.01);
(Continued)

(58) Field of Classification Search
CPC ..... G09G 3/3696; G09G 2320/0252; G09G 2360/16; G09G 3/3614; G09G 3/3648; G09G 3/3655
(Continued)

(56) References Cited

U.S. PATENT DOCUMENTS

2010/0053147 A1 3/2010 Choi et al.
2012/0062610 A1* 3/2012 Tai ..... G09G 3/3614 345/690

FOREIGN PATENT DOCUMENTS

CN 102402956 A 4/2012
JP 2007-033514 A 2/2007
(Continued)

OTHER PUBLICATIONS

Korean Office Action dated Jun. 30, 2014; Appln. No. 10-2013-0109662.
Third Chinese Office Action Appln. No. 201210339495.1; Dated Oct. 21, 2014.
Korean Notice of Allowance Appln. No. 10-2013-0109662; Dated Dec. 28, 2014.
(Continued)

*Primary Examiner* — Jose Soto Lopez
(74) *Attorney, Agent, or Firm* — Ladas & Parry LLP

(57) ABSTRACT

The present disclosure provides a driving method and apparatus of a liquid crystal display apparatus and a liquid crystal display apparatus, and belongs to a liquid crystal display field. The driving method comprises: generating gray scale data of sub-pixels according to received image data; taking a plurality of sub-pixels as a processing unit, generating gray scale voltage polarity signals, which are used for making gray scale voltages of the plurality of sub-pixels tend to zero entirely, respectively corresponding to the gray scale data of the plurality of sub-pixels; outputting the gray scale data and the corresponding polarity signal of the each sub-pixel to a source driver of the liquid crystal display apparatus. The
(Continued)

present disclosure may improve display defects caused by turbulence in a common voltage, such as a green attachment, a crosstalk, a flicker, etc.

16 Claims, 5 Drawing Sheets

(52) U.S. Cl.
CPC ..... *G09G 2230/00* (2013.01); *G09G 2310/06* (2013.01); *G09G 2320/0204* (2013.01); *G09G 2320/0209* (2013.01); *G09G 2320/0223* (2013.01); *G09G 2320/0247* (2013.01); *G09G 2330/025* (2013.01)

(58) Field of Classification Search
USPC ..... 345/87, 94, 96, 208, 214, 690
See application file for complete search history.

(56) References Cited

FOREIGN PATENT DOCUMENTS

| | | | |
|---|---|---|---|
| JP | 2008-286863 | A | 11/2008 |
| JP | 2009-180825 | A | 8/2009 |
| JP | 2011-007889 | A | 1/2011 |
| KR | 20120017161 | A | 2/2012 |

OTHER PUBLICATIONS

First Chinese Office Action dated Nov. 28, 2013; Appln. No. 201210339495.1.

Extended European Search Report dated Oct. 18, 2016; Appln. No. 13182700.8-1903/2709097.

Japanese Office Action dated Apr. 10, 2017; Appln. No. 2013-190300.

* cited by examiner

| | 1 | 2 | 3 | 4 | 5 | 6 | 7 | 8 |
|---|---|---|---|---|---|---|---|---|
| 1 | + | - | + | - | + | - | + | - |
| 2 | - | + | - | + | - | + | - | + |
| 3 | + | - | + | - | + | - | + | - |
| 4 | - | + | - | + | - | + | - | + |
| 5 | + | - | + | - | + | - | + | - |
| 6 | - | + | - | + | - | + | - | + |
| 7 | + | - | + | - | + | - | + | - |
| 8 | - | + | - | + | - | + | - | + |

Nth frame

| | 1 | 2 | 3 | 4 | 5 | 6 | 7 | 8 |
|---|---|---|---|---|---|---|---|---|
| 1 | - | + | - | + | - | + | - | + |
| 2 | + | - | + | - | + | - | + | - |
| 3 | - | + | - | + | - | + | - | + |
| 4 | + | - | + | - | + | - | + | - |
| 5 | - | + | - | + | - | + | - | + |
| 6 | + | - | + | - | + | - | + | - |
| 7 | - | + | - | + | - | + | - | + |
| 8 | + | - | + | - | + | - | + | - |

(N+1)th frame

| | 1 | 2 | 3 | 4 | 5 | 6 | 7 | 8 | 9 | 10 | 11 | 12 |
|---|---|---|---|---|---|---|---|---|---|---|---|---|
| 1 | 127 | 0 | 127 | 0 | 127 | 0 | 127 | 0 | 127 | 0 | 127 | 0 |
| 2 | 127 | 0 | 127 | 0 | 127 | 0 | 127 | 0 | 127 | 0 | 127 | 0 |
| 3 | 127 | 0 | 127 | 0 | 127 | 0 | 127 | 0 | 127 | 0 | 127 | 0 |
| 4 | 127 | 0 | 127 | 0 | 127 | 0 | 127 | 0 | 127 | 0 | 127 | 0 |
| 5 | 127 | 0 | 127 | 0 | 127 | 0 | 127 | 0 | 127 | 0 | 127 | 0 |
| 6 | 127 | 0 | 127 | 0 | 127 | 0 | 127 | 0 | 127 | 0 | 127 | 0 |
| 7 | 127 | 0 | 127 | 0 | 127 | 0 | 127 | 0 | 127 | 0 | 127 | 0 |
| 8 | 127 | 0 | 127 | 0 | 127 | 0 | 127 | 0 | 127 | 0 | 127 | 0 |

lookup table

| gray scale data | 0 | 32 | 64 | 96 | 127 | 160 | 192 | 224 | 255 |
|---|---|---|---|---|---|---|---|---|---|
| gray scale voltage amplitude | 4.0 | 3.0 | 2.6 | 2.2 | 1.8 | 1.6 | 1.4 | 1.0 | 0.2 |

| | 1 | 2 | 3 | 4 | 5 | 6 | 7 | 8 | 9 | 10 | 11 | 12 |
|---|---|---|---|---|---|---|---|---|---|---|---|---|
| 1 | +127 | -0 | +127 | +0 | -127 | -0 | +127 | +0 | -127 | -0 | +127 | +0 |
| 2 | -127 | +0 | -127 | -0 | +127 | +0 | -127 | -0 | +127 | +0 | -127 | -0 |
| 3 | +127 | -0 | +127 | +0 | -127 | -0 | +127 | +0 | -127 | -0 | +127 | +0 |
| 4 | -127 | +0 | -127 | -0 | +127 | +0 | -127 | -0 | +127 | +0 | -127 | -0 |
| 5 | +127 | -0 | +127 | +0 | -127 | -0 | +127 | +0 | -127 | -0 | +127 | +0 |
| 6 | -127 | +0 | -127 | -0 | +127 | +0 | -127 | -0 | +127 | +0 | -127 | -0 |
| 7 | +127 | -0 | +127 | +0 | -127 | -0 | +127 | +0 | -127 | -0 | +127 | +0 |
| 8 | -127 | +0 | -127 | -0 | +127 | +0 | -127 | -0 | +127 | +0 | -127 | -0 |

DRIVING METHOD AND APPARATUS OF LIQUID CRYSTAL DISPLAY APPARATUS, AND LIQUID CRYSTAL DISPLAY APPARATUS

TECHNICAL FIELD

The present invention relates to a field of liquid crystal display, and particularly to a driving method and apparatus of a liquid crystal display apparatus and the liquid crystal display apparatus, capable of improving display defects caused by turbulence in a common voltage, such as a green attachment, a crosstalk, a flicker, etc.

BACKGROUND

A Thin Film Transistor Liquid Crystal Display (TFT-LCD) is a display manner used widely currently. FIG. 1 is a block diagram illustrating a driving circuit of an existing thin film transistor liquid crystal display, and as illustrated in FIG. 1, the driving circuit comprises: a timing controller (TCON), a source driver, a gate driver and a gray scale voltage generator. The timing controller sends gray scale data signals RGB, a polarity inversion signal POL, a latch signal TP to the source driver, sends a frame start signal STV, a clock signal CPV and an output enable signal OE to the gate driver. The gate driver and the source driver output row signals and column signals, respectively, so as to control a liquid crystal display panel (LCD panel) to display.

The liquid crystal display is of a voltage driving type, that is, a transmittance of a liquid crystal box is controlled by applying different voltages at two terminals of the liquid crystal box, so as to implement the display. Each of pixels is generally divided into R sub-pixel, G sub-pixel and B sub-pixel, wherein one terminal of each of the sub-pixels is a common potential to which a same voltage referred to as a common voltage Vcom is applied, and the other terminal of each of the sub-pixels is a pixel voltage supplied by the source driver. If the voltages applied to the liquid crystal box remain a same polarity, the liquid crystal would be polarized and fail to operate, therefore the liquid crystal driving is implemented by polarity inversion schemes. If a pixel voltage is smaller than the common voltage Vcom, it is referred to as a negative polarity driving; if the pixel voltage is greater than the common voltage Vcom, it is referred to as a positive polarity driving. Manners of the polarity inversion are varied, such as a frame inversion, a row inversion, a column inversion, a point inversion, etc. As illustrated in FIG. 2, which is a schematic diagram of an existing point inversion driving manner, the driving polarities of adjacent sub-pixels are opposite. In particular, in the Nth frame, the polarity of the sub-pixel at the first column of the first row is + (positive polarity driving), the polarity of the sub-pixel at the second column of the first row is − (negative polarity driving), the polarity of the sub-pixel at the third column of the first row is + (positive polarity driving), and so on; the polarity of the sub-pixel at the first column of the second row is −, the polarity of the sub-pixel at the second column of the second row is +, the polarity of the sub-pixel at the third column of the second row is −, and so on; and at the next frame (the (N+1)th frame), the polarities of the all sub-pixels in the (N+1)th frame are opposite to those of the corresponding sub-pixels in the Nth frame. Such driving manner is optimal for a picture quality because the polarity in the entire picture reaches a balance.

However a case of polarity unbalance may still occur in same special pictures and cause a phenomenon of green attachment. For example, when a window picture is displayed, colors at two sides of the window may different from colors at other positions, that is, a so-called lateral crosstalk occurs. Generation reasons for such phenomenon are as follows: the liquid crystal display adopts a row scan manner, when gates of one row are turned on, the pixel voltages of all sub-pixels are written to the respective sub-pixels through respective data electrodes, but a coupling capacitor exists between each of the data electrodes and the Vcom electrode, such that a capacitor coupling effect would occur and pull up or down the Vcom voltage if the pixel voltages of the one row are unbalanced, which may cause errors in voltages written actually. As illustrated in FIG. 3, the point inversion driving manner is adopted, but amplitudes of the gray scale voltages at the two adjacent pixels are different, such that the pixel voltages on the first row are negative entirely and pull down the Vcom voltage, while the pixel voltages on the second row are positive entirely and pull up the Vcom voltage. Since the Vcom is a reference common voltage, its deviation may lead to errors in the actual voltage across the pixel.

SUMMARY

A technical problem to be solved by the present disclosure is to provide a driving method and a driving apparatus of a liquid crystal display apparatus, and the liquid crystal display apparatus in order to improve display defects caused by turbulence in a common voltage, such as a green attachment, a crosstalk, a flicker, etc.

In order to settle the above technical problem, the present disclosure provides solutions as follows.

A driving method of a liquid crystal display apparatus comprises: generating gray scale data of sub-pixels according to received image data; taking a plurality of sub-pixels as a processing unit, generating gray scale voltage polarity signals, which are used for making gray scale voltages of the plurality of sub-pixels tend to zero entirely, respectively corresponding to the gray scale data of the plurality of sub-pixels; and outputting the gray scale data and the corresponding polarity signal of each sub-pixel to a source driver of the liquid crystal display apparatus.

In the above method, wherein the step of taking a plurality of sub-pixels as a processing unit, generating gray scale voltage polarity signals, which are used for making gray scale voltages of the plurality of sub-pixels tend to zero entirely, respectively corresponding to the gray scale data of the plurality of sub-pixels comprises: setting the gray scale voltage polarity signal corresponding to the gray scale data of a first sub-pixel of the plurality of sub-pixels as an initial value; and setting the gray scale voltage polarity signal corresponding to the gray scale data of a nth sub-pixel of the plurality of sub-pixels as a polarity signal opposite to a polarity signal obtained by summing the gray scale voltages corresponding to the gray scale data of previous n−1 sub-pixels, wherein $2 \le n \le M$, and M is the total number of sub-pixels included in the plurality of sub-pixels.

In the above method, wherein the plurality of sub-pixels are half a row of sub-pixels, a plurality of rows of sub-pixels or sub-pixels in a predetermined area.

In the above driving method, wherein taking a plurality of sub-pixels as a processing unit, generating gray scale voltage polarity signals, which are used for making gray scale voltages of the plurality of sub-pixels tend to zero entirely, respectively corresponding to the gray scale data of the plurality of sub-pixels comprises: taking a row of sub-pixels as a processing unit, generating gray scale voltage polarity signals, which are used for making gray scale voltages of the corresponding row tend to zero entirely, respectively corresponding to the gray scale data of sub-pixels in the row.

In the above driving method, wherein the step of generating gray scale voltage polarity signals respectively corresponding to the gray scale data of sub-pixels in the row, comprises: setting the gray scale voltage polarity signal corresponding to the gray scale data of a sub-pixel at a first column in the row as an initial value; and setting the gray scale voltage polarity signal corresponding to the gray scale data of a sub-pixel at a nth column in the row as a polarity signal opposite to a polarity signal obtained by summing the gray scale voltages corresponding to the gray scale data of sub-pixels at previous n−1 columns in the row, wherein $2 \leq n \leq N$, and N is the total number of sub-pixels in one row.

In the above driving method, wherein the initial values of the polarities corresponding to sub-pixels at the first columns in two adjacent rows within a frame of picture of the image data are opposite.

In the above driving method, wherein the initial values of the polarities corresponding to sub-pixels at the first columns of the first rows within two adjacent frames of picture of the image data are opposite.

In the above driving method, wherein the step of generating gray scale voltage polarity signals respectively corresponding to the gray scale data of sub-pixels in the row is preferably implemented by means of analysis by a polarity analyzer according to a driving characteristic of the liquid crystal display apparatus.

A driving apparatus of a liquid crystal display apparatus comprises a timing controller, a gate driver and a source driver, wherein the driving apparatus further comprises a polarity analyzer; the polarity analyzer is used for, taking a plurality of sub-pixels as a processing unit, generating gray scale voltage polarity signals, which are used for making gray scale voltages of the plurality of sub-pixels tend to zero entirely, respectively corresponding to the gray scale data of the plurality of sub-pixels; and the timing controller is used for generating the gray scale data of the sub-pixels according to received image data, and outputting the gray scale data of the each sub-pixel and the corresponding gray scale voltage polarity signal obtained by the polarity analyzer to the source driver.

In the above apparatus, wherein the polarity analyzer further comprises: a first setting unit for setting the gray scale voltage polarity signal corresponding to the gray scale data of a first sub-pixel of the plurality of sub-pixels as an initial value; and a second setting unit for setting the gray scale voltage polarity signal corresponding to the gray scale data of a nth sub-pixel of the plurality of sub-pixels as a polarity signal opposite to a polarity signal obtained by summing the gray scale voltages corresponding to the gray scale data of previous n−1 sub-pixels, wherein $2 \leq n \leq M$, and M is the total number of sub-pixels included in the plurality of sub-pixels.

In the above driving apparatus, wherein the plurality of sub-pixels are half a row of sub-pixels, a plurality of rows of sub-pixels or sub-pixels in a predetermined area.

In the above driving apparatus, wherein the polarity analyzer is further used for taking a row of sub-pixels as a processing unit, generating gray scale voltage polarity signals, which are used for making gray scale voltages of the corresponding row tend to zero entirely, respectively corresponding to the gray scale data of sub-pixels in the row.

In the above driving apparatus, wherein the polarity analyzer further comprises: a third setting unit for setting the gray scale voltage polarity signal corresponding to the gray scale data of a sub-pixel at a first column in each row as an initial value; and a fourth setting unit for setting the gray scale voltage polarity signal corresponding to the gray scale data of a sub-pixel at a nth column in the row as a polarity signal opposite to a polarity signal obtained by summing the gray scale voltages corresponding to the gray scale data of sub-pixels at previous n−1 columns in the row, wherein $2 \leq n \leq N$, and N is the total number of sub-pixels in one row.

In the above driving apparatus, wherein: the initial values of the polarities corresponding to sub-pixels at the first columns in two adjacent rows within a frame of picture of the image data are opposite.

In the above driving apparatus, wherein: the polarities of the initial values corresponding to sub-pixels at the first columns of the first rows within two adjacent frames of picture of the image data are opposite.

In the above driving apparatus, wherein the polarity analyzer analyzes according to a driving characteristic of the liquid crystal display apparatus and generates the gray scale voltage polarity signals respectively corresponding to the gray scale data of sub-pixels in each row.

A liquid crystal display apparatus comprises the above driving apparatus and a liquid crystal panel connected with the driving apparatus.

As compared with the prior art, the driving method of the liquid crystal display apparatus according to the embodiments of the present disclosure may generate gray scale data of sub-pixels according to the received image data, generate gray scale voltage polarity signals respectively corresponding to the gray scale data of the plurality of sub-pixels, and output the gray scale data and the corresponding polarity signal of the each sub-pixel to the source driver of the liquid crystal display apparatus. Because the gray scale voltage polarity signals may make the gray scale voltages of the plurality of sub-pixels tend to zero entirely, a pulling influence on the common voltage Vcom can be avoided, so that it improves display defects caused by turbulence in a common voltage, such as a green attachment, a crosstalk, a flicker, etc, and in turn enhances a display effect.

In the driving apparatus of the liquid crystal display apparatus according to the embodiments of the present disclosure, the polarity analyzer is newly added, and the polarity analyzer may analyze the gray scale data of the plurality of sub-pixels and generate the gray scale voltage polarity signals, which are used for making gray scale voltages of the plurality of sub-pixels tend to zero entirely, respectively corresponding to the gray scale data of the plurality of sub-pixels, therefore a pulling influence on the common voltage Vcom can be avoided, so that it improves display defects caused by turbulence in a common voltage, such as a green attachment, a crosstalk, a flicker, etc, and in turn enhances a display effect.

DETAILED DESCRIPTION

Objects, solutions and advantages of the present disclosure will be more apparent from the following detailed description taken in conjunction with the accompanying drawings.

During the liquid crystal display driving, if the polarities of the gray scale voltages of the sub-pixels in each row is unbalance, it may pull the common voltage Vcom up or down and lead to the display defects such as a green attachment, a crosstalk, a flicker, etc. The embodiments of the present disclosure take a plurality of sub-pixels as a processing unit, generate the gray scale voltage polarity signals, which may be used for making gray scale voltages of the plurality of sub-pixels tend to zero entirely, respectively corresponding to the gray scale data of the plurality of sub-pixels, therefore a pulling influence on the common voltage Vcom can be avoided and the display defects may be improved.

The present disclosure provides a driving method of a liquid crystal display apparatus, for improving the display defects caused by turbulence in a common voltage, such as a green attachment, a crosstalk, a flicker, etc.

Figure 10:
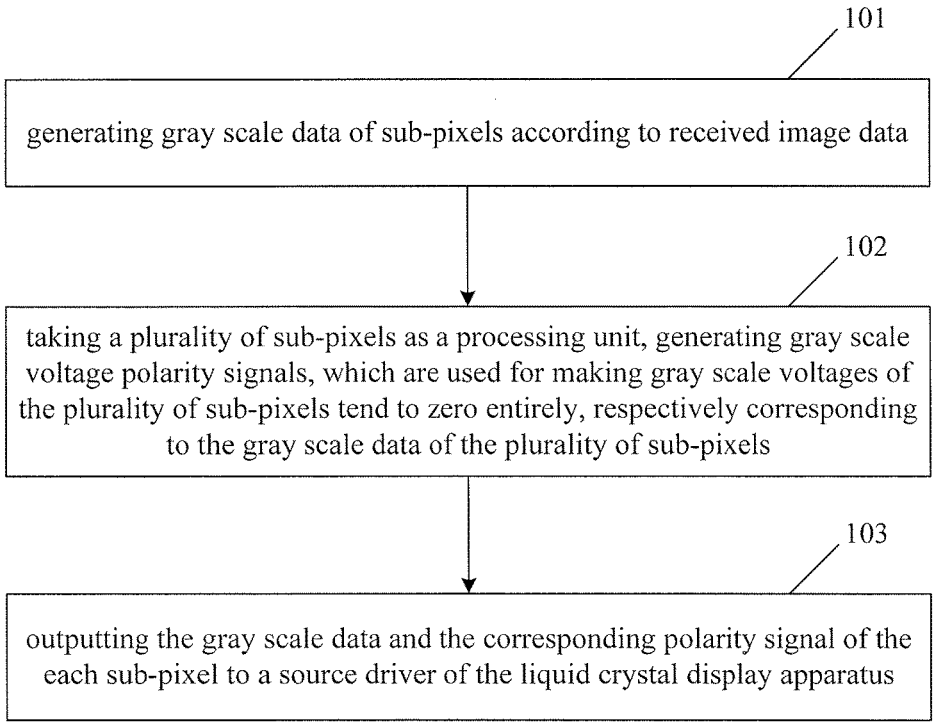
FIG. 10 is a flowchart illustrating a driving method of the liquid crystal display apparatus according to the embodiments of the present disclosure.

As illustrated in FIG. 10, which is a flowchart illustrating a driving method of the liquid crystal display apparatus according to the embodiments of the present disclosure, the driving method may comprises steps as follows.

In Step 101, gray scale data of sub-pixels is generated according to received image data.

Image data input externally is acquired and processed, and the gray scale data (RGB data) of the sub-pixels may be generated.

In Step 102, a plurality of sub-pixels are taken as a processing unit, gray scale voltage polarity signals, which are used for making gray scale voltages of the plurality of sub-pixels tend to zero entirely, are generated respectively corresponding to the gray scale data of the plurality of sub-pixels.

In particular, the gray scale voltage polarity signal corresponding to the gray scale data of a first sub-pixel of the plurality of sub-pixels may be set as an initial value, and then the gray scale voltage polarity signal corresponding to the gray scale data of a nth sub-pixel of the plurality of sub-pixels may be set as a polarity signal opposite to a polarity signal obtained by summing the gray scale voltages corresponding to the gray scale data of the previous n−1 sub-pixels, wherein $2 \leq n \leq M$, and M is the total number of sub-pixels included in the plurality of sub-pixels, so that the gray scale voltages of the plurality of sub-pixels tend to zero entirely.

The plurality of sub-pixels may be several sub-pixels in one row, and also may be half a row of sub-pixels, two or more rows of sub-pixels or sub-pixels in a predetermined area. For example, when a half-row driving is adopted, the half row of sub-pixels may be set as a processing unit; and when an area driving is adopted, the sub-pixels in the predetermined area may be set as a processing unit.

In an example, in the Step 102, a row of sub-pixels are taken as a processing unit, gray scale voltage polarity signals, which are used for making gray scale voltages of the corresponding row tend to zero entirely, are generated respectively corresponding to the gray scale data of sub-pixels in the row.

In the Step 102, the gray scale voltage polarity signals of sub-pixels may be generated specially by means of analysis by a polarity analyzer according to a driving characteristic of the liquid crystal display apparatus.

Figures 5, 6:
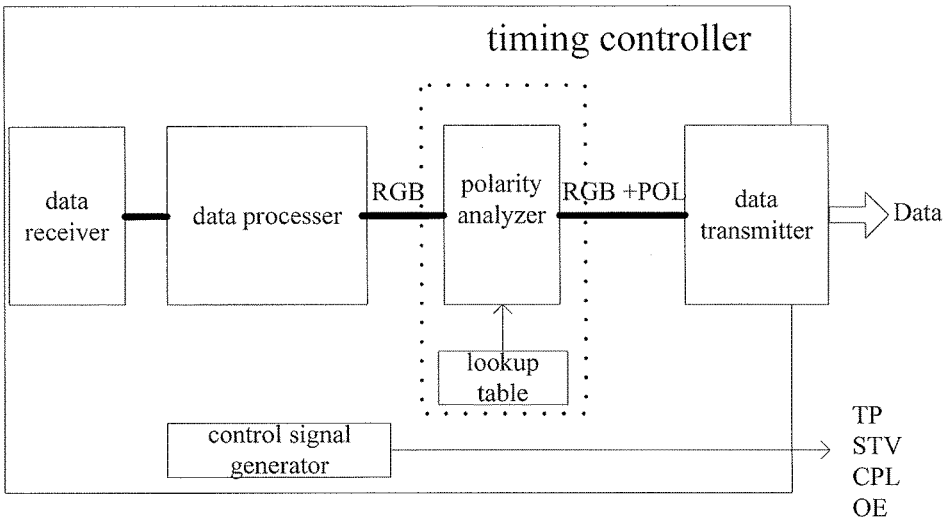
FIG. 5 is a block diagram illustrating a structure of a timing controller according to the embodiments of the present disclosure.
FIG. 6 is a schematic diagram illustrating gray scale data of a frame of picture before being processed by a polarity analyzer according to the embodiments of the present disclosure.

FIG. 6 illustrates gray scale data (RGB data) of a frame of picture. The driving characteristic of the liquid crystal display apparatus decides a corresponding relationship between gray scale data and a voltage applied across a sub-pixel actually, therefore data in the corresponding relationship table, that is a lookup table, of the gray scale data and the gray scale voltage amplitudes is decided by the driving characteristic of the liquid crystal display apparatus. The corresponding relationship between the gray scale data and the gray scale voltage amplitudes may be implemented by a gray scale voltage generator.

Figures 7, 8:
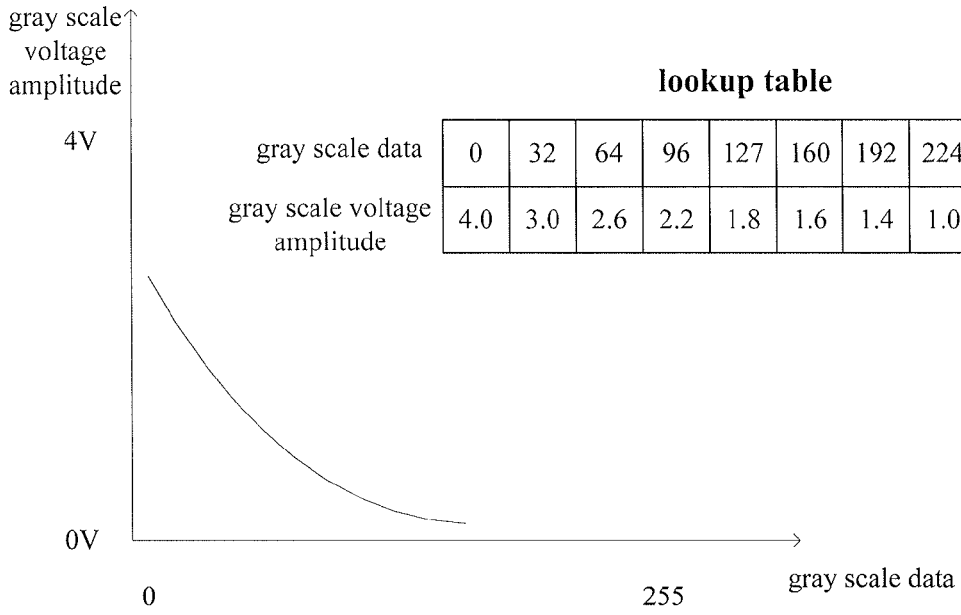
FIG. 7 is a schematic diagram illustrating a corresponding relationship between the gray scale data and gray scale voltage amplitudes according to the embodiments of the present disclosure.
FIG. 8 is a schematic diagram illustrating data after being processed by the polarity analyzer according to the embodiments of the present disclosure.

FIG. 7 illustrates a schematic diagram of the corresponding relationship table, i.e. the lookup table, of the gray scale data and the gray scale voltage amplitudes of the liquid crystal display in a normal-white mode, that is, the voltage of the gray scale 0 is highest, the voltage of the gray scale 255 is lowest, and it displays a white picture when no voltage is applied.

FIG. 7 illustrates a 3-order lookup table, wherein the voltages of the gray scales 0, 32, 64, 96, 127, 160, 192, 224 and 255 may be obtained by looking up the table directly. Other voltages, such as the voltage of the gray scale 20 may be obtained by an interpolation between the voltages of two gray scales 0 and 32. The lookup table may be enhanced to a 4-order, a 5-order, or even a 8-order in order to increase an algorithm precision.

A detailed method for generating the polarity signals may comprise: setting the gray scale voltage polarity signal corresponding to the gray scale data of a sub-pixel at a first column in each row as an initial value; and setting the gray scale voltage polarity signal corresponding to the gray scale data of a sub-pixel at a nth column in each row as a polarity signal opposite to a polarity signal obtained by summing the gray scale voltages (including the amplitudes of the gray scale voltage and the polarities of the gray scale voltage) corresponding to the gray scale data of sub-pixels at previous n−1 columns in the row, wherein $2 \leq n \leq N$, and N is the total number of sub-pixels in one row.

In the one frame of picture illustrated in FIG. 6, the gray scale data of the sub-pixel at the first column of the first row is 127, and a corresponding gray scale voltage amplitude is obtained by looking up the lookup table illustrated in FIG. 7, namely, 1.8, the polarity signal is initially set as +, that is, the gray scale voltage is +1.8; the gray scale data of the sub-pixel at the second column of the first row is 0, a corresponding voltage amplitude is obtained by looking up the lookup table illustrated in FIG. 7, namely, 4.0, and because the polarity of the gray scale voltage of the sub-pixel at the first column of the first row is positive, the voltage polarity signal for the second column of the first row is set as negative, that is, the gray scale voltage of is −4.0, thus the sum of the gray scale voltages of the previous two columns in the first row is 1.8+(−4.0)=−2.6 and shows the negative polarity; the gray scale voltage polarity signal of the sub-pixel at the third column of the first row is set as +; and the polarities of the data at subsequent respective columns in this row are determined according to the previous data: the polarity signal of the sub-pixel is positive if the polarity obtained by summing the gray scale voltages of sub-pixels in the row before this column shows the negative polarity, and the polarity signal of the sub-pixel is negative if the polarity obtained by summing the gray scale voltages of sub-pixels in the row before this column shows the positive polarity.

Optionally, the initial values of the polarities corresponding to the sub-pixels at the first columns in two adjacent rows in one frame of picture within the image data are opposite with each other. The initial value of the gray scale voltage polarity signal corresponding to the gray scale data at the first column of the second row is opposite to that of the gray scale voltage at the first column of the first row, namely, −. The polarities of the data at subsequent respective columns are obtained in the same manner and the polarities of the gray scale voltages in other respective rows are set in the same manner, so that the polarities of the gray scale voltages in two adjacent rows are as opposite as possible.

Optionally, the initial values of the polarities corresponding to sub-pixels at the first columns of the first rows within two adjacent frames of picture of the image data are opposite. For a next frame of the picture, the polarity of the gray scale voltage of the sub-pixel at the first column of the first row may be set as negative, which is opposite to that in the previous frame, so that the polarities of the gray scale voltages within two adjacent frames are opposite for a same sub-pixel.

In Step 103, the gray scale data and the corresponding polarity signal of the each sub-pixel is output to a source driver of the liquid crystal display apparatus.

The source driver may output a corresponding pixel voltage to the liquid crystal panel and control the liquid crystal panel to display according to the gray scale data and the polarity signal after receiving the gray scale data and the corresponding polarity signal of the each sub-pixel.

The driving method of the liquid crystal display apparatus according to the embodiments of the present disclosure may generate gray scale data of sub-pixels according to received image data, generate gray scale voltage polarity signals respectively corresponding to the gray scale data of a row of sub-pixels, and output the gray scale data and the corresponding polarity signal of each sub-pixel to a source driver of the liquid crystal display apparatus. Because the gray scale voltage polarity signals may make the gray scale voltages of the corresponding row of sub-pixels tend to zero entirely, a pulling influence on the common voltage Vcom can be avoided, so that it improves display defects caused by turbulence in the common voltage, such as a green attachment, a crosstalk, a flicker, etc, and in turn enhances a display effect.

The present disclosure provides a driving apparatus of a liquid crystal display apparatus, for improving the display defects caused by turbulence in a common voltage, such as a green attachment, a crosstalk, a flicker, etc.

Figure 4:
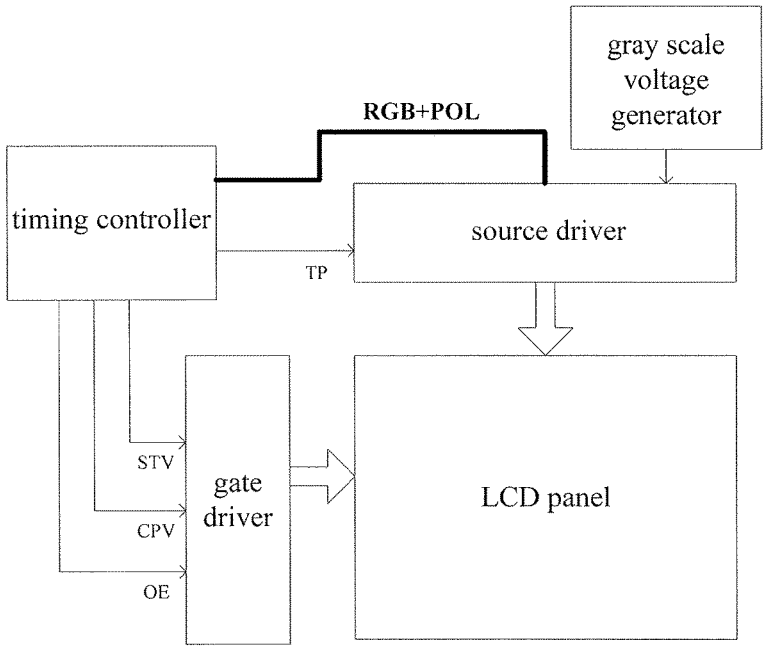
FIG. 4 is a block diagram illustrating a structure of a liquid crystal display apparatus according to the embodiments of the present disclosure.

FIG. 4 is a block diagram illustrating a structure of a liquid crystal display apparatus according to the embodiments of the present disclosure, wherein the liquid crystal display apparatus may comprise a driving apparatus and a liquid crystal panel connected with the driving apparatus.

In particular, the driving apparatus of the liquid crystal display apparatus according to the embodiments of the present disclosure may comprise a timing controller (TCON), a source driver, a gate driver and a gray scale voltage generator. The timing controller sends gray scale data (RGB), gray scale voltage polarity signals POL corresponding to the gray scale data and a latch signal TP to the source driver, sends a frame start signal STV, a clock signal CPV and an output enable signal OE to the gate driver. The source driver and the gate driver output row signals and column signals, respectively, so as to control the liquid crystal display panel (the LCD panel) to display.

As seen from FIG. 4, no fixed polarity conversion signal POL is set in the embodiment of the present disclosure, and the gray scale voltage polarity signal of each sub-pixel is generated by a polarity analyzer in the timing controller. Further, the embodiment of the present disclosure is not limited to the case where the polarity analyzer must be included in the timing controller.

The polarity analyzer takes a plurality of sub-pixels as a processing unit, and generates the gray scale voltage polarity signals, which are used for making gray scale voltages of the plurality of sub-pixels tend to zero entirely, respectively corresponding to the gray scale data of the plurality of sub-pixels.

In particular, the polarity analyzer may comprise: a first setting unit for setting the gray scale voltage polarity signal corresponding to the gray scale data of a first sub-pixel of the plurality of sub-pixels as an initial value; and a second setting unit for setting the gray scale voltage polarity signal corresponding to the gray scale data of a nth sub-pixel of the plurality of sub-pixels as a polarity signal opposite to a polarity signal obtained by summing the gray scale voltages corresponding to the gray scale data of the previous n−1 sub-pixels, wherein $2 \leq n \leq M$, and M is the total number of sub-pixels included in the plurality of sub-pixels.

The plurality of sub-pixels may be several sub-pixels in one row, and also may be half a row of sub-pixels, two or more rows of sub-pixels or sub-pixels in a predetermined area. For example, when a half-row driving is adopted, the half row of sub-pixels may be set as a processing unit; and when an area driving is adopted, the sub-pixels in the predetermined area may be set as a processing unit.

Preferably, the polarity analyzer calculates the gray scale voltage polarity signals respectively corresponding to the gray scale data of sub-pixels in each of rows by calculating the gray scale data of the sub-pixels in the row, inputs the polarity signals into the source driver along with the gray scale data, and the source driver generates data voltages to drive the LCD panel. Because the polarity signal of each sub-pixel is calculated and generated by the polarity analyzer, it may control the gray scale voltages in each row to tend to zero entirely and avoid the pulling influence on the common voltage Vcom.

FIG. 5 is a block diagram illustrating a structure of a timing controller according to the embodiments of the present disclosure, wherein the timing controller may comprise a data receiver, a data processor, the polarity analyzer, a lookup table, a data transmitter and a control signal generator. The data receiver receives the image data input externally, the data processer processes the input image data and generates the gray scale data (RGB data) of the sub-pixels; after the polarity analyzer analyzes the gray scale data of one row, it generates the gray scale voltage polarity signals POL respectively corresponding to the gray scale data; the lookup table provides the polarity analyzer with a basis used for analysis; the gray scale data and the gray scale voltage polarity signals POL generated by the polarity analyzer are input to the data transmitter; the data transmitter sends the gray scale data and the corresponding gray scale voltage polarity signals POL to the source driver; the control signal generator generates the latch signal TP, the frame start signal STV, the clock signal CPV and the output enable signal OE, and outputs them to the source driver or the gate driver, respectively.

In the embodiments of the present disclosure, the polarity analyzer generates the gray scale voltage polarity signals respectively corresponding to the gray scale data of the sub-pixels by analyzing the gray scale data of the sub-pixels according to a driving characteristic of the liquid crystal display apparatus. The polarity analyzer takes a row of sub-pixels as a processing unit, and generates the gray scale voltage polarity signals, which are used for making gray scale voltages of the corresponding row tend to zero entirely, respectively corresponding to the gray scale data of sub-pixels in the row. The polarity analyzer further comprises: a third setting unit for setting the gray scale voltage polarity signal corresponding to the gray scale data of a sub-pixel at a first column in each row as an initial value; and a fourth setting unit for setting the gray scale voltage polarity signal corresponding to the gray scale data of a sub-pixel at a nth column in each row as a polarity signal opposite to a polarity signal obtained by summing the gray scale voltages corresponding to the gray scale data of sub-pixels at previous n−1 columns in the row, wherein $2 \leq n \leq N$, and N is the total number of sub-pixels in one row.

Optionally, the initial values of the polarities corresponding to sub-pixels at the first columns in two adjacent rows within one frame of picture of the image data are opposite; the initial values of the polarities corresponding to sub-pixels at the first columns of the first rows within two adjacent frames of picture of the image data are opposite.

An operation method of the polarity analyzer will be illustrated thereafter.

FIG. 6 illustrates the gray scale data (RGB data) of one frame of picture generated by the data processer. There is a corresponding relationship between the gray scale data and a voltage applied across the sub-pixel actually, and the corresponding relationship between the gray scale data and the gray scale voltage amplitudes is implemented by the gray scale voltage generator, as illustrated in FIG. 7. The corresponding relationship between the gray scale data and the gray scale voltage amplitudes is for a normal-white mode liquid crystal display, that is, the voltage of the gray scale 0 is highest, the voltage of the gray scale 255 is lowest, and it displays a white picture when no voltage is applied. A lookup table may be generated according to the corresponding relationship between the gray scale data and the gray scale voltage amplitudes. FIG. 7 illustrates a 3-order lookup table, wherein the voltages of 0, 32, 64, 96, 127, 160, 192, 224 and 255 may be obtained by looking up the table directly. Other voltages, such as the voltage of the gray scale 20 may be obtained by an interpolation between the voltages of two gray scales 0 and 32. The lookup table may be enhanced to a 4-order, a 5-order, or even a 8-order in order to increase an algorithm precision.

In the one frame of picture illustrated in FIG. 6, the gray scale data of the sub-pixel at the first column of the first row is 127, and a corresponding gray scale voltage amplitude is obtained by looking up the lookup table illustrated in FIG. 7, namely, 1.8, a polarity signal is initially set as +, that is, the gray scale voltage is +1.8; the gray scale data of the sub-pixel at the second column of the first row is 0, a corresponding voltage amplitude is obtained by looking up the lookup table illustrated in FIG. 7, namely, 4.0, and because the polarity of the gray scale voltage of the sub-pixel at the first column of the first row is positive, the voltage polarity signal for the second column of the first row is set as negative, that is, the gray scale voltage of is −4.0, thus the sum of the gray scale voltages of the previous two columns in the first row is 1.8+(−4.0)=−2.6 and shows the negative polarity; the polarity signal of the gray scale voltage of the sub-pixel at the third column of the first row is set as +; and the polarities of the data at subsequent respective columns in this row are determined according to the previous data: the polarity signal of the sub-pixel is positive if the polarity obtained by summing the gray scale voltages of sub-pixels in the row before this column shows the negative polarity, and the polarity signal of the sub-pixel is negative if the polarity obtained by summing the gray scale voltages of sub-pixels in the row before this column shows the positive polarity.

The initial value of the polarity signal of the gray scale voltage corresponding to the gray scale data at the first column of the second row is opposite to that of the gray scale voltage at the first column of the first row, namely, −. The polarities of the data at subsequent respective columns are obtained in the same manner and the polarities of the gray scale voltages in other respective rows are set in the same manner, so that the polarities of the gray scale voltages in two adjacent rows are as opposite as possible. For a next frame of the picture, the polarity of the gray scale voltage of the sub-pixel at the first column of the first row may be set as negative, which is opposite to that in the previous frame, so that the polarities of the gray scale voltage within two adjacent frames are opposite for a same sub-pixel.

Figures 1, 2:
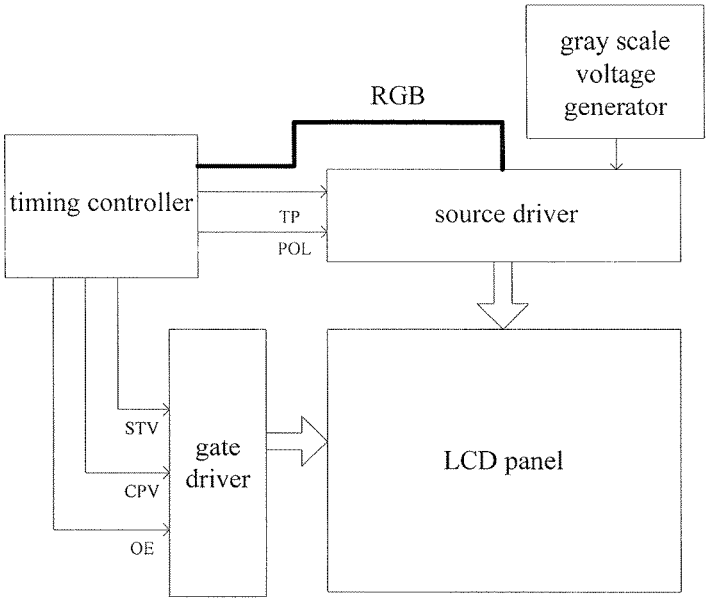
FIG. 1 is a block diagram illustrating a driving circuit of an existing thin film transistor liquid crystal display.
FIG. 2 is a schematic diagram illustrating an existing point inversion driving manner.
Figure 3:
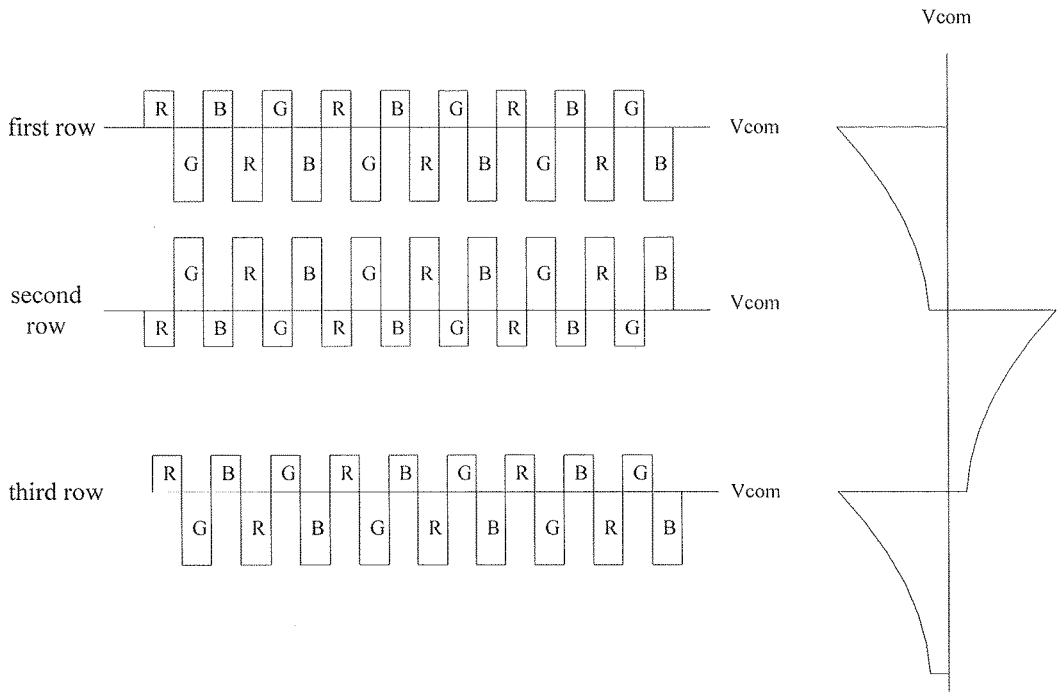
FIG. 3 is a schematic diagram illustrating a case wherein a common voltage generated by the existing point inversion driving manner is pulled.
Figure 9:
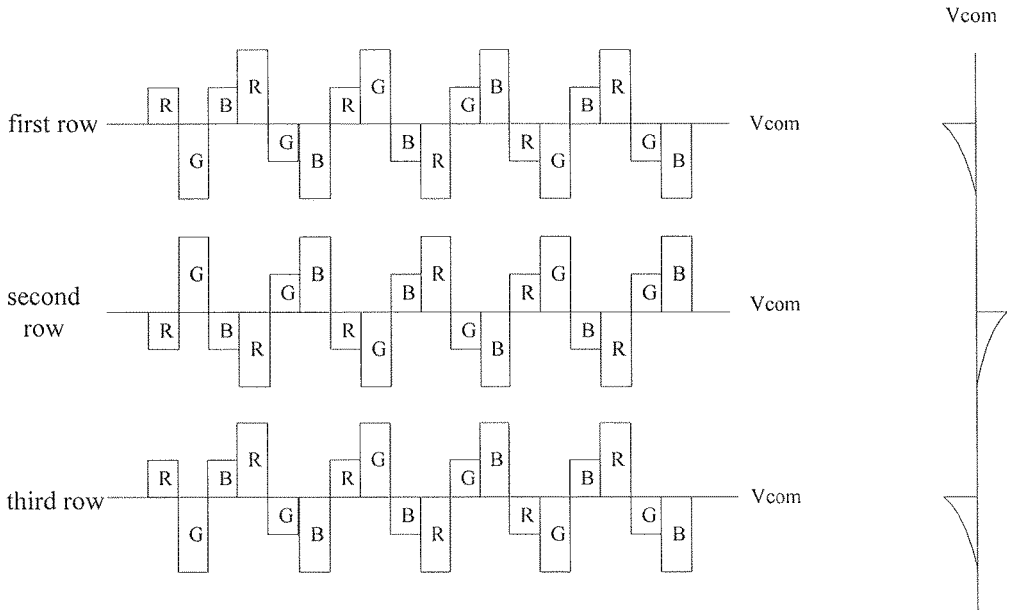
FIG. 9 is a diagram illustrating an effect after the polarity analyzer processes according to the embodiments of the present disclosure.

According to the above-described algorithm, a data table finally obtained by analysis by means of the polarity analyzer is as illustrated in FIG. 8, and its implementation effect is illustrated in FIG. 9 wherein the polarity of each row tends to zero. For the data in a same frame of the picture, the pulling effect on the Vcom by the conventional point inversion manner is as shown in FIG. 3. A resolution of the general liquid crystal display panel is very high, and each row may comprise 3,000 sub-pixels generally, even up to 6,000 sub-pixels. With the above-described polarity balance algorithm provided in the embodiments of the present disclosure, the gray scale voltages in each row may tend to zero entirely, thus it can improve display defects caused by turbulence in a common voltage, such as a green attachment, a crosstalk, a flicker, etc, and in turn enhance a display effect.

In the driving apparatus of the liquid crystal display apparatus according to the embodiments of the present disclosure, the polarity analyzer is newly added, and the polarity analyzer may analyze the gray scale data of a row of sub-pixels and generate the gray scale voltage polarity signals, which are used for making gray scale voltages of the row of sub-pixels tend to zero entirely, respectively corresponding to the gray scale data of the row of sub-pixels, therefore a pulling influence on the common voltage Vcom can be avoided, so that it improves display defects caused by turbulence in a common voltage, such as a green attachment, a crosstalk, a flicker, etc, and in turn enhances a display effect.

At last, please note that the embodiments of the present disclosure being thus described are only for purpose of illustration rather than limitation, and modifications and equivalent alternatives may be made to the embodiments of the present disclosure without departing from spirit and scope of the present disclosure as defined in the flowing claims.

What is claimed is:

1. A driving method of a liquid crystal display apparatus, comprising:

generating gray scale data of sub-pixels according to received image data;

taking a plurality of sub-pixels as a processing unit, setting a gray scale voltage polarity signal corresponding to the gray scale data of a first sub-pixel of the plurality of sub-pixels as an initial value; and setting a gray scale voltage polarity signal corresponding to the gray scale data of an nth sub-pixel of the plurality of sub-pixels as a polarity signal opposite to a polarity signal obtained by summing the gray scale voltages corresponding to the gray scale data of previous n−1 sub-pixels, wherein n is increased from 2 to M, and M is the total number of sub-pixels included in the plurality of sub-pixels;

outputting the gray scale data and the corresponding polarity signal of each sub-pixel to a source driver of the liquid crystal display apparatus;

wherein the gray level voltage polarities of respective sub-pixels in the processing unit are set sequentially one by one.

2. The driving method according to claim 1, wherein the plurality of sub-pixels are half a row of sub-pixels, a plurality of rows of sub-pixels or sub-pixels in a predetermined area.

3. The driving method according to claim 1, wherein the plurality of sub-pixels is one row of the sub-pixels, and the step of taking a plurality of sub-pixels as a processing unit, generating gray scale voltage polarity signals respectively corresponding to the gray scale data of the plurality of sub-pixels comprises:

setting the gray scale voltage polarity signal corresponding to the gray scale data of a sub-pixel at a first column in the row as an initial value; and setting the gray scale voltage polarity signal corresponding to the gray scale data of a sub-pixel at a nth column in the row as a polarity signal opposite to a polarity signal obtained by summing the gray scale voltages corresponding to the gray scale data of sub-pixels at previous n−1 columns in the row, wherein $2 \leq n \leq N$, and N is the total number of sub-pixels in one row.

4. The driving method according to claim 3, wherein the initial values of the polarities corresponding to sub-pixels at the first columns in two adjacent rows within a frame of picture of the image data are opposite.

5. The driving method according to claim 3, wherein the initial values of the polarities corresponding to sub-pixels at the first columns of the first rows within two adjacent frames of picture of the image data are opposite.

6. A driving apparatus of a liquid crystal display apparatus, comprising a timing controller, a gate driver and a source driver, wherein the driving apparatus further comprises a polarity analyzer;

the polarity analyzer is used for taking a plurality of sub-pixels as a processing unit, and comprises:

a first setting unit for setting the gray scale voltage polarity signal corresponding to the gray scale data of a first sub-pixel of the plurality of sub-pixels as an initial value; and a second setting unit for setting the gray scale voltage polarity signal corresponding to the gray scale data of a nth sub-pixel of the plurality of sub-pixels as a polarity signal opposite to a polarity signal obtained by summing the gray scale voltages corresponding to the gray scale data of previous n−1 sub-pixels, wherein n is increased from 2 to M, and M is the total number of sub-pixels included in the plurality of sub-pixels;

the timing controller is used for generating the gray scale data of the sub-pixels according to a received image data, and outputting the gray scale data of the each sub-pixel and the corresponding gray scale voltage polarity signal obtained by the polarity analyzer to the source driver;

wherein the gray level voltage polarities of respective sub-pixels in the processing unit are set sequentially one by one.

7. The driving apparatus according to claim 6, wherein the plurality of sub-pixels are half a row of sub-pixels, a plurality of rows of sub-pixels or sub-pixels in a predetermined area.

8. The driving apparatus according to claim 6, wherein the plurality of sub-pixels is one row of the sub-pixels, and the polarity analyzer comprises:

a third setting unit for setting the gray scale voltage polarity signal corresponding to the gray scale data of a sub-pixel at a first column in each row as an initial value; and a fourth setting unit for setting the gray scale voltage polarity signal corresponding to the gray scale data of a sub-pixel at a nth column in each row as a polarity signal opposite to a polarity signal obtained by summing the gray scale voltages corresponding to the gray scale data of sub-pixels at previous n−1 columns in the row, wherein $2 \leq n \leq N$, and N is the total number of sub-pixels in one row.

9. The driving apparatus according to claim 8, wherein:

the initial values of the polarities corresponding to sub-pixels at the first columns in two adjacent rows within a frame of picture of the image data are opposite.

10. The driving apparatus according to claim 8, wherein:

the initial values of the polarities corresponding to sub-pixels at the first columns of the first rows within two adjacent frames of picture of the image data are opposite.

11. The driving apparatus according to claim 6, wherein the polarity analyzer analyzes according to a driving characteristic of the liquid crystal display apparatus and generates the gray scale voltage polarity signals respectively corresponding to the gray scale data of sub-pixels in each row.

12. A liquid crystal display apparatus comprising a driving apparatus and a liquid crystal panel connected with the driving apparatus, wherein the driving apparatus comprises a timing controller, a gate driver, a source driver and a polarity analyzer;

the polarity analyzer is used for taking a plurality of sub-pixels as a processing unit, and comprises:

a first setting unit for setting the gray scale voltage polarity signal corresponding to the gray scale data of a first sub-pixel of the plurality of sub-pixels as an initial value; and a second setting unit for setting the gray scale voltage polarity signal corresponding to the gray scale data of a nth sub-pixel of the plurality of sub-pixels as a polarity signal opposite to a polarity signal obtained by summing the gray scale voltages corresponding to the gray scale data of previous n−1 sub-pixels, wherein n is increased from 2 to M, and M is the total number of sub-pixels included in the plurality of sub-pixels;

the timing controller is used for generating the gray scale data of the sub-pixels according to a received image data, and outputting the gray scale data of the each sub-pixel and the corresponding gray scale voltage polarity signal obtained by the polarity analyzer to the source driver;

wherein the gray level voltage polarities of respective sub-pixels in the processing unit are set sequentially one by one.

13. The liquid crystal display apparatus according to claim 12, wherein the plurality of sub-pixels are half a row of sub-pixels, a plurality of rows of sub-pixels or sub-pixels in a predetermined area.

14. The liquid crystal display apparatus according to claim 12, wherein the plurality of sub-pixels is one row of the sub-pixels, and the polarity analyzer comprises:

a third setting unit for setting the gray scale voltage polarity signal corresponding to the gray scale data of a sub-pixel at a first column in each row as an initial value; and a fourth setting unit for setting the gray scale voltage polarity signal corresponding to the gray scale data of a sub-pixel at a nth column in each row as a polarity signal opposite to a polarity signal obtained by summing the gray scale voltages corresponding to the gray scale data of sub-pixels at previous n−1 columns in the row, wherein $2 \leq n \leq N$, and N is the total number of sub-pixels in one row.

15. The liquid crystal display apparatus according to claim 14, wherein:

the initial values of the polarities corresponding to sub-pixels at the first columns in two adjacent rows within a frame of picture of the image data are opposite.

16. The liquid crystal display apparatus according to claim 14, wherein:

the initial values of the polarities corresponding to sub-pixels at the first columns of the first rows within two adjacent frames of picture of the image data are opposite.

* * * * *